United States Patent [19]

Tomforde et al.

[11] Patent Number: 4,927,106

[45] Date of Patent: May 22, 1990

[54] PRESENTATION PODIUM

[75] Inventors: Johann Tomforde, Sindelfingen; Monika Wall, Stuttgart, both of Fed. Rep. of Germany

[73] Assignee: Daimler-Benz Aktiengesellschaft, Stuttgart, Fed. Rep. of Germany

[21] Appl. No.: 241,248

[22] Filed: Sep. 7, 1988

[30] Foreign Application Priority Data

Sep. 7, 1987 [DE] Fed. Rep. of Germany ..... 3729904

[51] Int. Cl.[5] ..... A47G 23/02

[52] U.S. Cl. ..... 248/146; 47/39; 47/72; 220/408

[58] Field of Search ..... 248/174, 146, 152; 220/408, 410, 23.83; 47/39, 72, 41.1

[56] References Cited

U.S. PATENT DOCUMENTS

| | | | |
|---|---|---|---|
| 485,011 | 10/1892 | Kneeland | 220/410 |
| 1,152,308 | 8/1915 | Evans | 220/408 |
| 1,849,866 | 3/1932 | de la Roza Sr. | 220/408 X |
| 1,885,788 | 11/1932 | Westburg | 220/408 X |
| 2,492,152 | 12/1949 | Hollowell | 220/146 X |
| 2,569,958 | 10/1951 | Struve et al. | 220/408 |
| 3,116,744 | 1/1964 | Hager | 220/408 |
| 4,014,506 | 3/1977 | Hanson | 47/72 X |
| 4,026,067 | 5/1977 | Wengel | 47/39 |
| 4,122,973 | 10/1978 | Ahern | 220/410 X |
| 4,287,887 | 9/1981 | Hinz et al. | 220/408 X |
| 4,623,113 | 11/1986 | Studebaker | 47/39 X |
| 4,690,299 | 9/1987 | Cannon | 220/410 X |

FOREIGN PATENT DOCUMENTS

| | | | |
|---|---|---|---|
| 8431566 | 2/1985 | Fed. Rep. of Germany | |
| 153799 | 11/1920 | United Kingdom | 248/146 |

*Primary Examiner*—David L. Talbott

*Attorney, Agent, or Firm*—Evenson, Wands, Edwards, Lenahan & McKeown

[57] ABSTRACT

A presentation podium is described which is versatile in use and in which the observer's attention is directed entirely to the goods to be displayed. For this purpose it is provided according to the invention that the presentation podium consists of a closed self-supporting, polygonal or circular frame to which inward-pointing horizontal support bolts are fastened in the region beneath its upper edge. Insert elements, such as platforms, plant tubs and the like, are insertable into the frame maintaining a uniform all-round air gap from the frame.

19 Claims, 2 Drawing Sheets

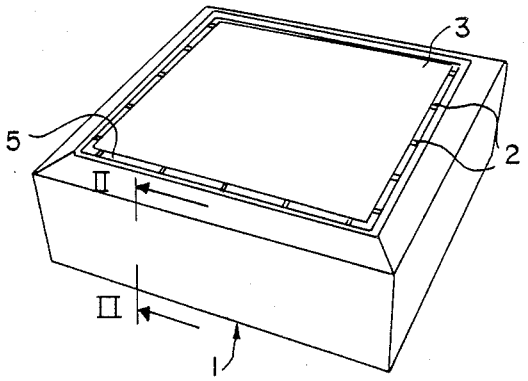
FIG. 1
FIG. 2
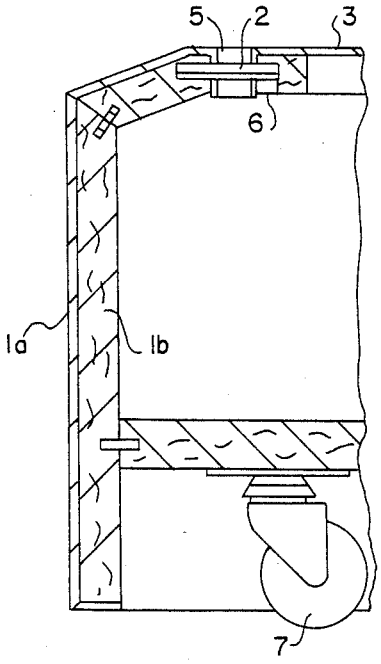
FIG. 3
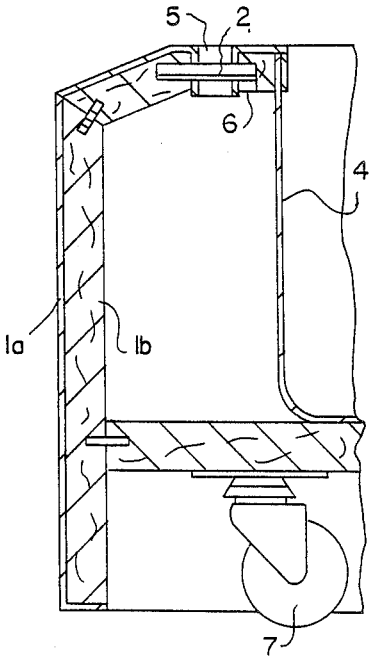

PRESENTATION PODIUM

BACKGROUND AND SUMMARY OF THE INVENTION

The invention relates to a presentation podium which exhibits a closed, self-supporting, polygonal or circular frame into which an insert element is insertable.

A podium of this general type is described in German GM 8,431,566.

An underlying object of the present invention is to develop such a podium further so that an ability for the placing and fastening of various accessory articles, including bulky ones, and for the attachment of price boards and notice boards, can be created in a simple manner.

This object is achieved according to the invention by providing an arrangement wherein inward-pointing horizontal support bolts are fastened in the region of the upper edge of the frame, and wherein the insert elements, such as platforms, plant tubs and the like are insertable into the frame while maintaining a uniform all-round air gap from the latter.

The frame may be produced in sandwich construction with the widest variety of material combinations.

Other objects, advantages and novel features of the present invention will become apparent from the following detailed description of the invention when considered in conjunction with the accompanying drawings.

BRIEF DESCRIPTION OF THE DRAWINGS

FIG. 1 is a perspective schematic view from above of a presentation podium constructed according to a preferred embodiment of the invention;

FIG. 2 shows on a larger scale a section along the line II—II in FIG. 1 with a platform in place;

FIG. 3 shows on the same scale a section corresponding to that of FIG. 2, but through an embodiment with an inserted plant tub;

DETAILED DESCRIPTION OF THE INVENTION

Figure 4:
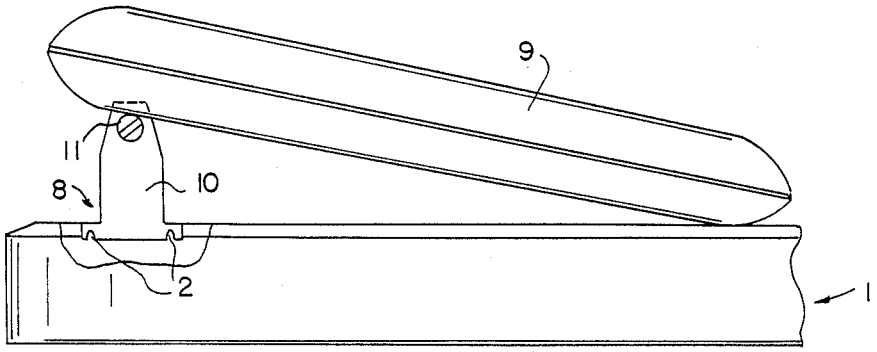
FIG. 4 shows a partly fragmented side elevation of a presentation podium with a bracing element plugged in for a ski box to be presented.

The presentation podium, illustrated in the drawing exhibits an inherently closed, rectangular self-supporting frame 1, which is composed—as FIGS. 2 and 3 show—of an outer sheet-metal skin 1*a* and an inner wood layer 1*b*. However, a wide variety of sandwich constructions would be conceivable here, such as aluminium/corrugated aluminium/aluminium, steel or aluminium with polyurethane (PU) foam on the inside, etc. Somewhat below the upper edge of the frame 1, horizontally extending inward-pointing support bolts 2 are fastened on its inside, upon which a platform 3 (FIG. 2) may be placed or a plant tub 4 (FIG. 3) inserted, for example. A uniform all-round air gap 5 then remains between the frame 1 and the platform 3 or the plant tub 4, which is ensured by the fact that the platform 3 and/or the plant tub 4 exhibit hook-in slots 6 with a correspondingly limited extension in depth.

The podiums are equipped with wheels 7 to facilitate moving them.

The support bolts 2 fulfill further functions in addition to those described above. Thus, accessory elements, the wall thickness of which in the region within the air gap should correspond approximately to the width of the air gap 5 in order to achieve a stable position, may respectively be placed on two support bolts 2 arranged adjacently. Thus, a bracing element 8 for a ski box 9 to be presented is shown in FIG. 4 of the drawing, which consists of two opposite retaining plates 10 which are connected by a rod 11, is supportable at the support bolts 2 at downwardly open slots of the plates 10.

Price boards or notice boards may be fitted to the presentation podiums via the support bolts in a similar manner.

In order to secure valuable exhibited good, such as tires for example, embodiments are also contemplated with a wire support cable provided with a lock and extended through beneath the support bolts and around the goods.

Figure 5:
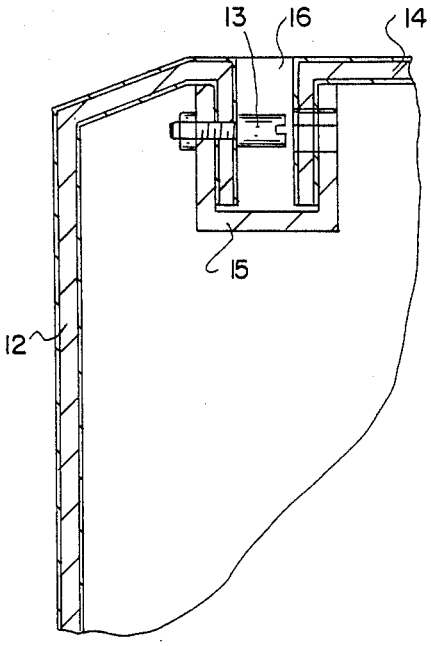
FIG. 5 shows a section corresponding to FIG. 2 through another embodiment of the invention.

Lastly, a somewhat varied embodiment of the invention is illustrated in FIG. 5 of the drawing. Here support bolts 13 are likewise arranged somewhat beneath the upper edge of a frame 12, upon which however a platform 14 provided with downward-angled edge regions is not placed directly. On the contrary, an engaging element 15 provided with a U-shaped cross-section is fastened to the frame 12 by the support bolts 13, and the platform 14 is hooked into it. The air gap 16 is created here, as in the embodiment of the invention previously described.

Although the present invention has been described and illustrated in detail, it is to be clearly understood that the same is by way of illustration and example only, and is not to be taken by way of limitation. The spirit and scope of the present invention are to be limited only by the terms of the appended claims.

We claim:

1. A convertible presentation podium comprising:

a closed, self supporting frame for receiving different insert elements each having different functional capabilities, horizontal support bolts inwardly directed with respect to the frame and fastened in a region beneath an upper edge of the frame, and one of the different insert elements inserted in the frame, the one of the different insert elements having means for cooperating with the horizontal support bolts to maintain an air gap between the one of the different insert elements inserted in the frame and the frame, the air gap having a uniform width and extending entirely around the one of the different insert elements inserted in the frame, wherein the means of the one of the different insert elements inserted in the frame are placed directly on the bolts which each have a given length.

2. A convertible presentation podium according to claim 1, wherein the width of the air gap is fixed by a lateral dimension of hook-in slots provided on the one of the different insert elements, the hook-in slots having an open bottom end and receiving and engaging the horizontal support bolts to define the width of the air gap.

3. A convertible presentation podium according to claim 2, wherein accessory parts having a wall thickness corresponding approximately to the width of the air gap, are attached on two or more adjacent ones of the support bolts.

4. A convertible presentation podium according to claim 2, wherein the width of the air gap is fixed by a lateral dimension of hook-in slots provided on each of the different insert elements, the hook-in slots having an open bottom end and receiving and engaging the horizontal support bolts to define the width of the air gap.

5. A convertible presentation podium according to claim 1, wherein accessory parts having a wall thickness corresponding approximately to the width of the air gap, are attached on two or more adjacent ones of the support bolts.

6. A convertible presentation podium according to claim 1, wherein accessory parts having a wall thickness corresponding approximately to the width of the air gap, are attached on two or more adjacent ones of the support bolts.

7. A convertible presentation podium according to claim 1, further comprising accessory attachment means for attaching accessory parts in the air gap.

8. A convertible presentation podium according to claim 7, wherein accessory parts, having a wall thickness corresponding approximately to the width of the air gap, are inserted in the air gap and attached to the accessory attachment means.

9. A convertible presentation podium according to claim 1, wherein the one of the different insert elements inserted in the frame is a platform.

10. A convertible presentation podium according to claim 1, wherein the one of the different insert elements inserted in the frame is a plant tub.

11. A convertible presentation podium according to claim 1, wherein the accessory attachment means comprises two or more adjacent ones of the support bolts.

12. A convertible presentation podium comprising:

a closed, self supporting frame for receiving different insert elements each having different functional capabilities, horizontal support bolts inwardly directed with respect to the frame and fastened in a region beneath an upper edge of the frame, and one of the different insert elements inserted in the frame, the one of the different insert elements having means for cooperating with the horizontal support bolts to maintain an air gap between the one of the different insert elements inserted in the frame and the frame, the air gap having a uniform width and extending entirely around the one of the different insert elements inserted in the frame, wherein the means of the one of the different insert elements inserted in the frame is a downwardly extending peripheral wall of the one of the different insert elements and wherein engaging means for engaging the downwardly extending peripheral wall of the one of the different insert elements are fastened to the frame by the horizontal support bolts to set the width of the air gap.

13. A convertible presentation podium according to claim 12, wherein the engaging means have a U-shaped cross-section.

14. A convertible presentation podium according to claim 12, wherein accessory parts having a wall thickness corresponding approximately to the width of the air gap, are attached on two or more adjacent ones of the support bolts.

15. A convertible presentation podium according to claim 12, further comprising accessory attachment means for attaching accessory parts in the air gap.

16. A convertible presentation podium according to claim 12, wherein the one of the different insert elements inserted in the frame is a platform.

17. A convertible presentation podium according to claim 12, wherein the one of the different insert elements inserted in the frame is a plant tub.

18. A convertible presentation podium according to claim 12, wherein the accessory attachment means comprises two or more adjacent ones of the support bolts.

19. A convertible presentation podium according to claim 18, wherein accessory parts, having a wall thickness corresponding approximately to the width of the air gap, are inserted in the air gap and attached to the accessory attachment means.

* * * * *